United States Patent [19]

Beckstein

[11] Patent Number: 4,890,924

[45] Date of Patent: Jan. 2, 1990

[54] PROCESS AND APPARATUS FOR MEASURING THE WEFT THREAD OR COURSE POSITION OF TEXTILE SHEETS

[75] Inventor: Hellmut Beckstein, Bad Abbach, Fed. Rep. of Germany

[73] Assignee: Mahlo GmbH & Co. KG., Saal/Donau, Fed. Rep. of Germany

[21] Appl. No.: 190,495

[22] Filed: May 5, 1988

[30] Foreign Application Priority Data

May 22, 1987 [DE] Fed. Rep. of Germany ..... 3717305

[51] Int. Cl.[4] ..... G01N 21/88

[52] U.S. Cl. ..... 356/429; 26/51.5; 250/563; 356/430; 356/238

[58] Field of Search ..... 356/237, 238, 429, 430; 250/562, 563; 26/51.5

[56] References Cited

U.S. PATENT DOCUMENTS 4,248,533 2/1981 Shimada ..... 356/238
4,255,050 3/1981 Beckstein et al. ..... 356/238
4,414,476 11/1983 Maddox et al. ..... 356/430
4,786,177 11/1988 Beckstein et al. ..... 356/430

*Primary Examiner*—F. L. Evans
*Attorney, Agent, or Firm*—Burgess, Ryan & Wayne

[57] ABSTRACT

The invention is a process and an apparatus for measuring the weft threads and draft angle for a continuously moving textile sheet. At least one long narrow section of the sheet is monitored by transmitted or reflected illumination. The long narrow section has a small width and long length in comparison with the thickness of the weft threads. The longitudinal axis of the section has a defined, constant angle in relation to the transport direction. The illuminated section is monitored by a sensor array. The brightness values within the section are divided in two classes (bright, dark), and those sensors within the field in which brightness values are the same, and that there be determined either the number of (total) length of the sensors within the same class or speed at which the sensors of one class move in the section, and that the draft angle of the weft thread is determined therefrom.

13 Claims, 5 Drawing Sheets

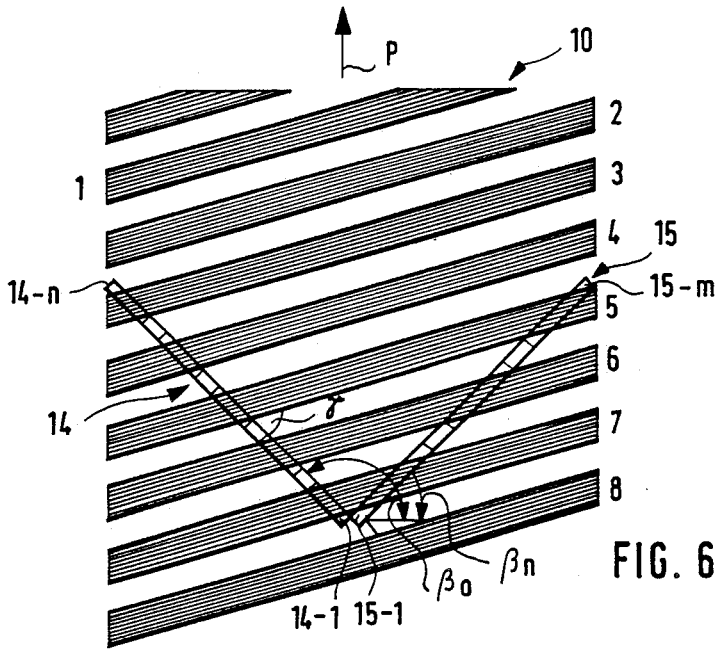
FIG. 6
FIG. 7
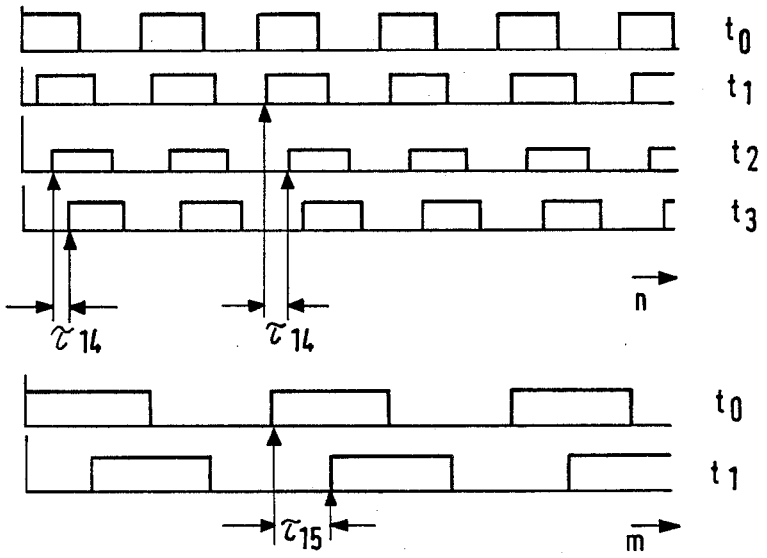

PROCESS AND APPARATUS FOR MEASURING THE WEFT THREAD OR COURSE POSITION OF TEXTILE SHEETS

The invention concerns a process and apparatus for measuring the draft angle of moving textile fabrics.

BACKGROUND OF THE INVENTION

In the production of textile fabrics, the warp threads and the weft threads intersect precisely at right angles. However, during subsequent processing of the fabrics, the fabric may become warped. In the production of knitted fabrics on circular knitting machines, the resulting circular fabric is cut and the knitted fabric is generally diagonally warped after cutting. In both cases, the warping is corrected by straightening machines which require the draft angle as a control value. Therefore, it is necessary to determine the draft angle of the weft threads on a moving textile fabric so that the angle can be corrected if required.

German Patent No. 16 35 266 discloses an apparatus for measuring the draft angle wherein a single aperture having a photosensor situated behind it is oscillated by an electrodynamic driving system, the oscillating movement taking place about a central axis at about the mechanical resonant frequency of the system. The speed of the oscillating movement, therefore, is predetermined by the system. The output signal of the photosensor is summed up by an amplifier, the sign of the amplification being always reversed when the draft angle exceeds the central angle. Therefore, the signal summed up over one period becomes zero when the measured value of the draft angle is symmetrically distributed about the central angle. This is the case when the weft thread has the same direction as the central angle. In addition, the known system provides a follow-up control device which, according to the measured value at a given moment, adjusts the whole system or the central angle in a manner such that the central angle always extends parallel with the weft thread. Thus, a direct measurement of the course of the weft thread or of the draft angle is possible by measuring the central angle.

This known system is deficient in that it requires mechanically moving parts which are necessarily subject to abrasion and wear. Because the speed of oscillation (resonant frequency) must be adapted to the advancing speed of the passing fabric, the inertial mass of the moving parts limits the speed at which the fabric can be advanced.

An apparatus is known wherein opposite to a light source, there are situated two photocells arranged behind slits whose central axes form angles with each other. From the differential signal of the photocells, a value for the angular course of the weft thread is determined without need for the system to be mechanically moved. What is important in this system is a correct measurement of the amount of light that penetrates through the textile sheet which, in the case of a single photosensor, causes certain difficulties, since the amount of light which penetrates through the fabric depends not only on the distances from each other of the weft threads and on the thickness thereof but also on the color of the textile sheet. In the case of printed materials and irregular textile fabrics, this causes difficulties. However, since in the known apparatus two electro-optical systems must be adjusted to each other, the difficulty associated with operation of the system is substantially increased. Another problem is the poor "pull-in range" of the system which is determined by the angle between the two slits.

Taking the above prior art as a point of departure, the problem solved by this invention is to perfect the process and apparatus as described above, in the sense of making it possible to obtain by simple, means a correct measurement of the course of the weft thread with low susceptibility to failure.

This problem is solved by the process and the apparatus of the invention.

BRIEF DESCRIPTION OF THE INVENTION

In the present invention, the illumination of a long narrow field in relation to the diameter of a thread of the fabric, is monitored by a photodetector comprising a linear array of photosensors, the intensity or amount of light reaching each photosensor in the array being monitored at predetermined time intervals. The state of each photosensor monitored is classified as bright or dark in relation to a threshold value of the amount of light reaching the sensor. The time intervals between each monitoring is sufficiently short so that each weft thread is monitored at least twice by an individual photosensing element as the illuminated fabric field passes the linear array of photosensing elements. The relation of the field and sensor elements is such that only one weft thread is monitored by an individual sensor element in the linear array of sensor elements.

The essential feature of the invention is that within the slit-like cutout or long narrow field, there is observed not the entire amount of light passing through the fabric but a "sample" thereof within a narrow field or the change of the sample within the narrow field. The brightness values can thus be divided into only two degrees (bright/dark), which substantially reduces the susceptibility to failure. When the brightness values or the change of brightness values are determined, the mathematical rule for determining the draft angle can be deduced from geometric reasoning.

BRIEF DESCRIPTION OF THE DRAWINGS

Preferred embodiments and other essential elements of the invention can be seen from the description of embodiments that follows as explained in more detail with reference to drawings, wherein:

FIG. 6 illustrates an arrangement of sensor elements according to another preferred embodiment of the invention;

FIG. 7 is an illustration of the course of output signals of an arrangement according to FIG. 6.

DETAILED DESCRIPTION OF THE INVENTION

Figure 1:
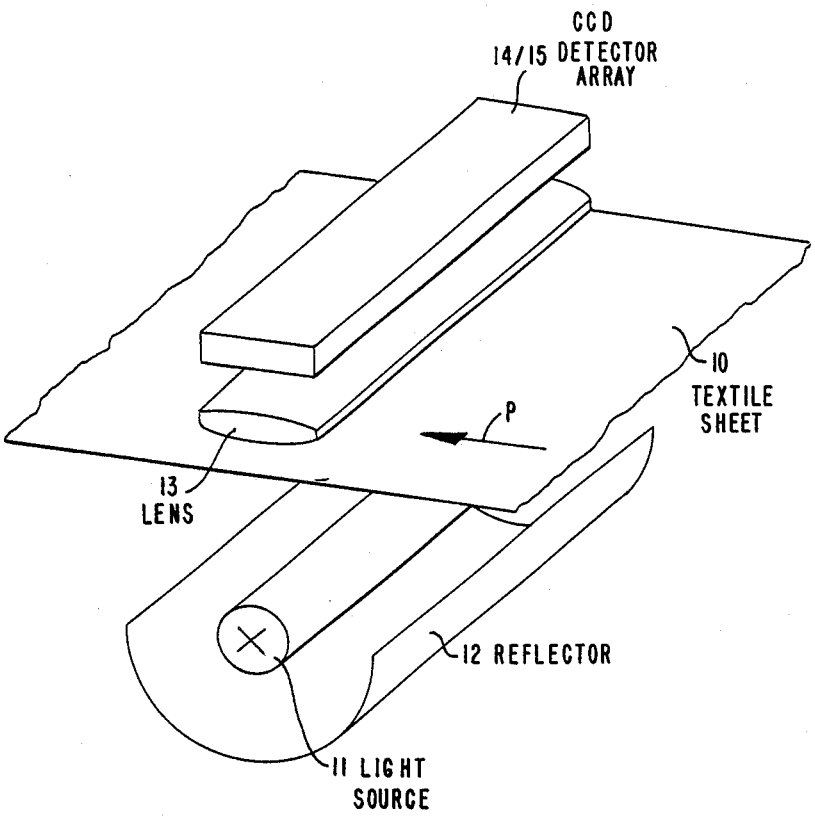
FIG. 1 is an illustration in perspective of the arrangement of illumination source, textile sheet and sensor in one embodiment of the invention.

FIG. 1 illustrates an arrangement in which a light source 11 having a reflector 12 situated behind it irradiates a textile sheet 10 which is moved past the arrangement in the direction of the arrow P. Opposite said light source 11 with said reflector 12, there is a CCD (charge coupled device) detector array 14 or 15 with a lens 13 positioned between the detector and the fabric. A plurality of these arrangements are provided over the whole width of the fabric sheet so that it is possible to detect even a garland distortion, for instance, by batch-bulk finding of the draft angle.

Figure 2:
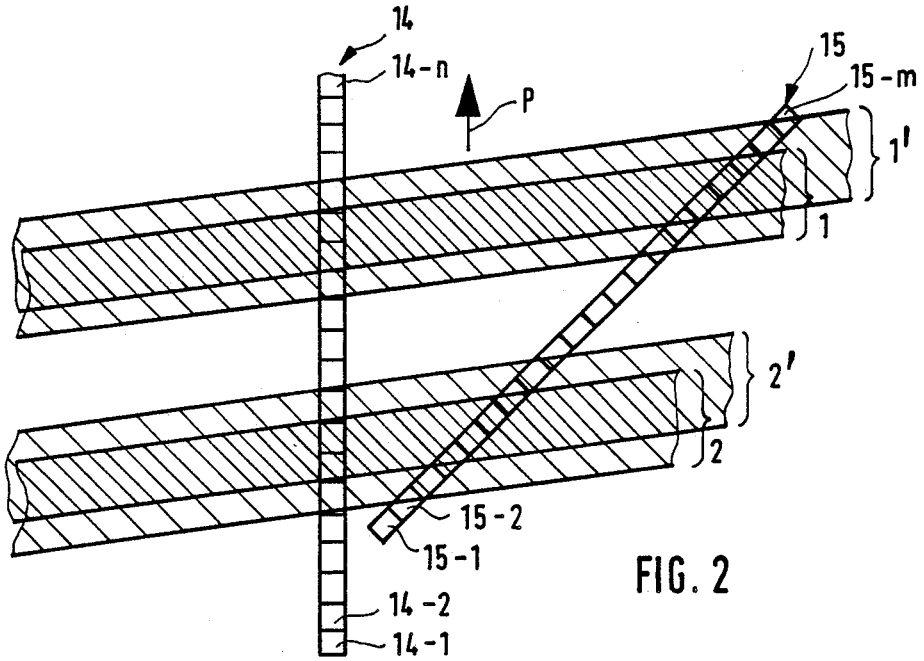
FIG. 2 is an illustration of the arrangement of two sensors in relation to the weft threads of a textile sheet.

In the embodiment illustrated in FIG. 2, the weft threads 1 and 2 appear as dark fields while the gaps therebetween appear as bright fields. When reflected light is utilized, the threads appear as bright fields. When the textile sheet is moved in the direction of the arrow P, the weft threads 1 and 2 move, as indicated in FIG. 2 with the plotted weft threads 1' and 2' being at a position at $t+\Delta t$. When the weft threads move past the CCD detector arrays 14 or 15, the individual sensor elements 14-1, 14-2 . . . ; 14-n or 15-1 . . . , 15-m of the CCD detector array 14 and 15 are gradually illuminated or darkened.

Figure 3:
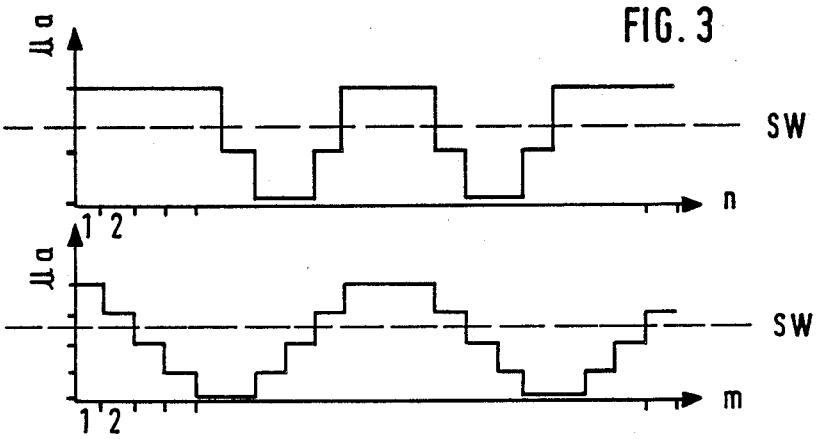
FIG. 3 is an illustration of the course of the output signal of the sensor system of FIG. 2.

The output signals of the individual elements of the CCD detector arrays 14 and 15 are (as is known) serially monitored, which is made clear in FIG. 3. Assuming the static case in which the rate of monitoring is very great compared to the advancing speed of the fabric sheet, FIG. 3 shows in the stage-like course of the output signals and also the "haziness" which necessarily occurs in the marginal areas between bright and dark zones. To obtain signals that can be correctly processed and are free from interference, the output signals of the sensor are compared with a threshold signal value SW. All values above the threshold signal value SW are classified as "bright" and all values below the threshold signal values SW are classified as "dark".

Assuming an "ideal" black-white sample formed by the weft threads 1, 2, there results at a higher speed of fabric travel which is not high compared to the monitoring rate, a signal pattern, as shown in FIG. 3. In this case, the pattern is developed from the periodic integration of the light flux impinging on the individual sensor elements 14-n, 15-m. There is also obtained here an increase of the signal to noise ratio due to the division of the signals into two groups by the threshold signal value SW. The monitoring rate must be sufficiently high to permit each thread to be monitored at least twice in relation to a single CCD sensor element in an array before the next thread is monitored. Higher monitoring rates permit a more accurate determination of the draft angle.

Figure 4:
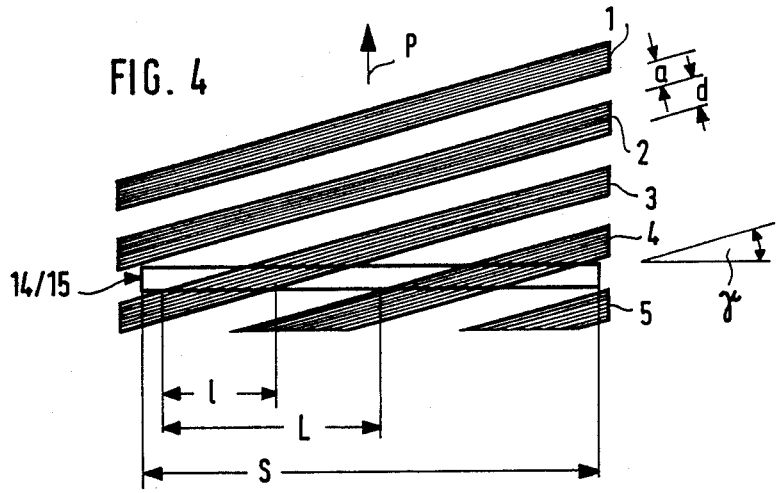
FIGS. 4 and 5 illustrate the parameters used in equations set forth in the specification.

When the divison of the monitored signals into bright and dark has been made with reference to the threshold signal value SW, the value of the draft angle which is really of interest can be calculated. To make clear the calculation, the parameters used are first explained in more detail with reference to FIGS. 4 and 5. The distance between two dark zones (weft threads 1 to 5) is designated by a, the thickness of the weft threads that is, the "dark field", is designated by d. The length of the phantom section shown in the figures corresponds to the length of the sensor array and is designated by S. The letter 1 designates the maximum length of a "dark group" that is, the number of the consecutively darkened sensor elements (multiplied by their length). The letter L designates the "period" corresponding to the above-mentioned value 1, that is, the length of the CCD sensor array line within which the pattern repeats itself. The figure $\alpha$ designates the draft angle that is, the angle between a weft thread 1 to 9 and an axis perpendicular to the transportation direction P (normal line to the transportation direction). The letters $\beta O$ or $\beta n$ designate the angle between the CCD sensor array 14, 15 and a line normal to the transportation direction, while $\gamma$ designates an angle between a CCD sensor array 14 or 15 and a weft thread.

The draft angle can be calculated as illustrated hereinafter.

The values a and d predetermined by the fabric are known. The angle $\gamma^{\nu}$ between the CCD sensor array and the weft threads is determined according to the equation $$\sin \gamma^{\nu} = \frac{a+d}{L} \tag{1}$$

at a predetermined angle $\beta$ of the CCD sensor array with a line normal to the transportation direction, the draft angle $\alpha$ is determined by;

$$\alpha = \beta - \gamma^{\nu}; \tag{2}$$

As can be easily seen from the above equations, positive and negative draft angles cannot be differentiated. This differentiation however, can be made by the rate of movement of the sample (the transportation speed). In the upper CCD sensor array 14 shown in FIG. 5, the speed of movement past the sensor array would be higher in positive draft angle $\alpha$ ( in the definition given in FIG. 5) than in negative draft angle $\alpha$. Besides, it is possible to find the "thread count" (weft threads per unit length) by an additional CCD sensor array positioned across the fabric normal to the transportation direction and use it in the above described calculation.

Figure 5:
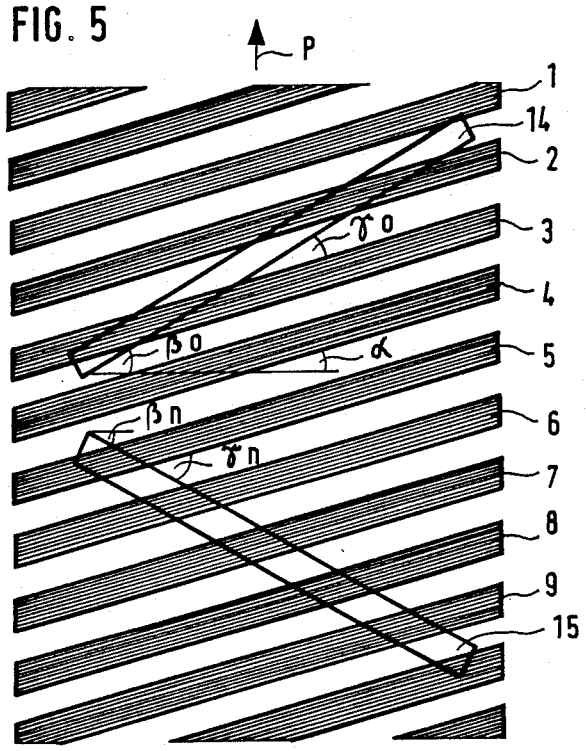

Another and simpler method for calculating the draft angle $\alpha$ results when selecting the arrangement chosen in FIG. 5 of two CCD arrays 14 and 15 directed toward each other forming an angle. In this case, the angle $\alpha$ results in equation (3)

$$tg\ \alpha = \frac{Zn \cdot \mathrm{Sin}\beta o + zO\ \mathrm{Sin}\beta n}{zO \cdot \mathrm{Cos}\beta n + zn\ \mathrm{Cos}\beta O} \tag{3}$$

wherein zn and zO are defined in equation 4:

$$z = 2 \cdot \frac{S}{L} \tag{4}$$

that is, zn and zO represent the "period number" divided by the CCD sensor array length (the subscripts n and O are noted and shown in FIG. 5).

In this embodiment of the process according to the invention, the calculation is specially simple when both angles $\beta O$ and $\beta n$ are selected of equal size. Equation 3 then is simplified to $$tg\ \alpha = \frac{zn - zo}{zn + zo} \cdot tg\ \beta O \tag{5}$$

wherein the above definitions apply. The determination of the draft angle $\alpha$ is especially simple because the CCD sensor arrays 14 and 15 work digitally and the values for z are present as computable individual values.

The $\beta O = \beta n$ angle is preferably selected to be 15°.

To obtain as great as possible precision, it is preferred that the CCD sensor array be as long as possible (in relation to the thread count). This can also be obtained with an adequate optical system in which a magnified reproduction of the thread of the fabric is projected on the CCD sensor array. The optical system permits the width of a sensor to be wider than an individual thread.

Instead of the above-mentioned method for determining the number of weft threads over a CCD sensor array, it is also possible (as indicated) to use for calculation the sum of the bright (or dark) stretches on the CCD sensor array. The draft angle $\alpha$ then results in $$tg\,\alpha = \frac{lo - \ln}{lo + \ln} \cdot tg\beta \qquad (6)$$

wherein there can also be used for calculation instead of the "dark" stretches" 1, the "bright stretches" (L - 1).

In another preferred embodiment of the invention, the numbers z or the lengths 1 are obtained via several scanning cycles of the CCD sensor array. A substantial increase of the signal-to-noise ratio is thereby possible.

Hereinbelow is described in more detail with reference to FIGS. 6 and 7, another preferred embodiment of the invention. In this (alternative) method of calculation, the speed of movement of the sample over the CCD sensor array 14; 15 is used as basis for the calculation.

Assuming that a scanning cycle of the CCD sensor array represents the quasi-static position of the weft threads 1 to 8 over the CCD line, there results the pattern shown in FIG. 7. When the first scanning cycle at the moment tO after dividing into bright and dark results in the pattern shown in FIG. 7, then the scanning cycle that follows at the t1 moment is moved to the right of this pattern; the same applies to all the scanning cycles that follow. The amount of movement is designated with $\tau$14 in FIG. 7.

Since the second CCD sensor array 14 forms an obtuse angle with the weft threads, the period to be observed there is shorter than that of the CCD sensor array 15. This is shown in FIG. 7 at the bottom. The time interval $\tau$15 according to FIG. 7 is therefore longer than the $\tau$14 interval observed with the CCD sensor array 14. The angle $\gamma^{\nu}$ between the CCD line and the weft threads 1 to 8 then results in $$tg\,\gamma^{\nu} = \frac{\tau 15 \cdot \sin\beta O + \tau 15 \cdot \sin\beta n}{\tau 14 \cos\beta n + \tau 15 \cos\beta O}$$

$$tg\,\gamma^{\nu} = \frac{\tau 15}{\tau 14} \Big| \text{for } \beta O = 90^\circ + \beta n = 135^\circ$$

wherein the draft angle $\alpha$ is calculated according to equation 2.

This embodiment of the invention has the added advantage that an average of the time intervals $\tau$14 and $\tau$15 used in equation 7 can be ascertained by rapidly monitoring individual values on the basis of the time intervals not only between ascending flanks of corresponding bright areas but also between the descending flanks.

Figure 8:
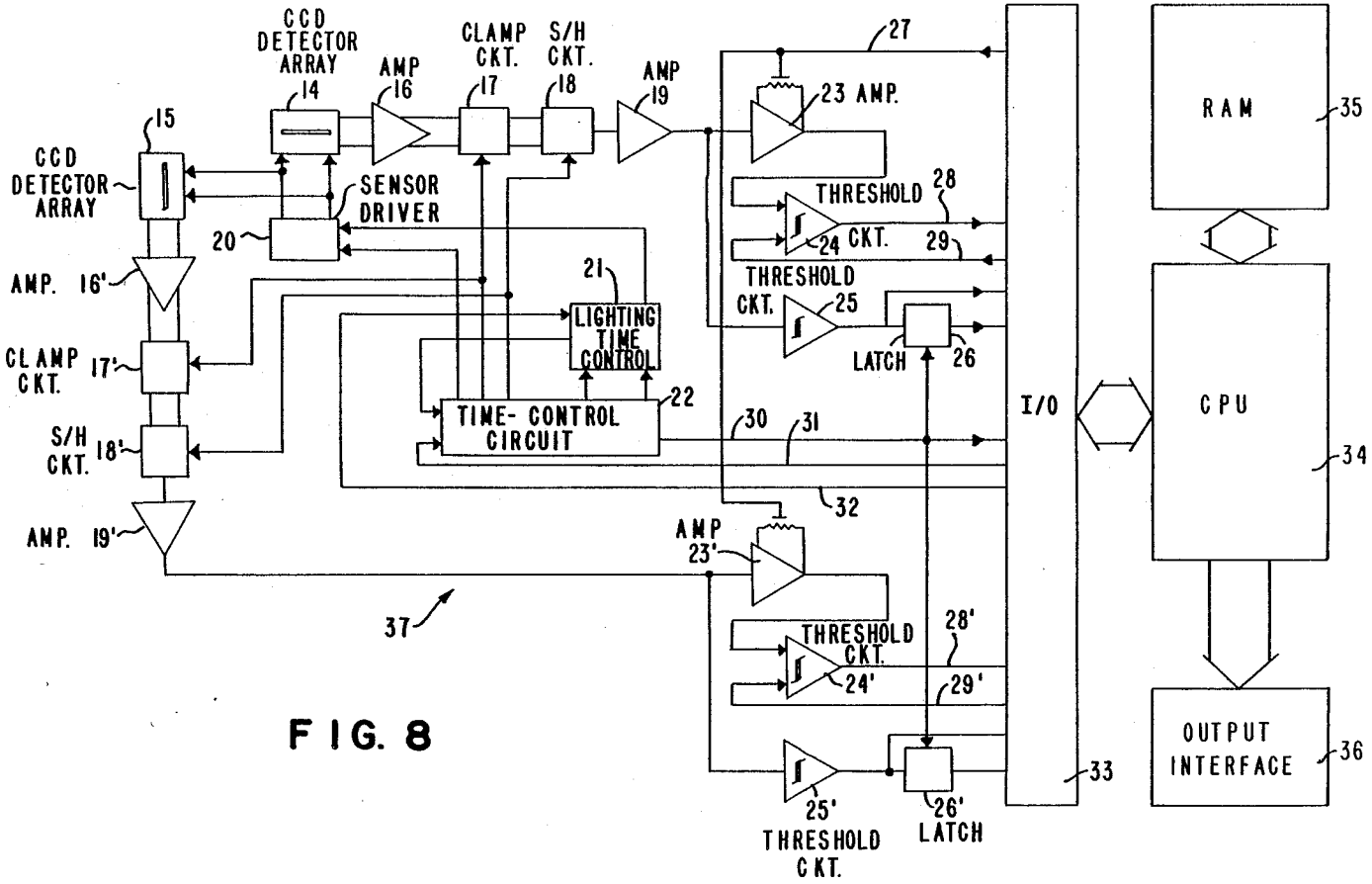
FIG. 8 is a block diagram of an evaluation device for two CCD sensor arrays.

FIG. 8 is an illustration of a circuit for carrying out the above described process.

As shown in FIG. 8, the CCD sensor arrays 14 and 15 are controlled via a common sensor driver 20 and relay their output signals which are proportional to the amount of light received via the buffer amplifiers 16, 16' and the clamp circuits 17, to the sample-and-hold circuits 18 and added buffer amplifiers 19, 19'. The clamp circuits 18 and 18' are like the sensor driver 20 - synchronized via a time-control circuit 22.

From the buffer amplifiers 19, 19', the output signals reach the inputs of controllable output amplifiers 23, 23' whose outputs are guided to inputs of threshold circuits 24 and 24' which effect the black/white discrimination. The output lines 28, 28' constitute, therefore, binary outputs guided into an input/output (I/O) interface.

The I/O interface 33 communicates with a CPU 34 which has access to a RAM 35 via data lines. There is provided in addition an output interface 36 controllably connected via data lines with the means for adjusting the draft angle.

To make it possible to watch the light source or the warning of an interference, the output signals of the buffer amplifiers 19, 19' are relayed to the I/O interface 33 via threshold circuits 25, 25'. By adequate adjustment of the threshold gauge, it is possible to establish whether the CCD sensor arrays 14, 15 receive too much light that is, are being operated at saturation. This saturation signal is further relayed via a latch 26, 26' to the I/O interface 33, each latch 26, 26' being controlled via a start signal line 30 which likewise is guided in the I/O interface 33.

The time-control circuit 22 controls, in addition to the sensor driver 20, a lighting time control 21 to which the CPU has direct access via the I/O interface 33 and the lighting control line 32. A sensor line 31 connects the time-control circuit 22 for synchronization with the CPU 34 (via the interface 33).

The threshold values SW (see FIG. 3) are adjustable via lines 29, 29' of the CPU 34.

The evaluation device 37 thus constructed can be programmed so as to carry out the above described process for calculating the draft angle.

The CCD sensor arrays 14, 15 do not have to be constructed as separate sensor array arrangements but can be arranged in a single matrix arrangement. The angles $\beta$O and $\beta$n are then defined by proper selection of the matrix elements.

In another preferred embodiment of the invention, there are provided two rectilinear converters of a system similar to that of FIG. 6. But these are not CCD sensor arrays but position-sensitive, rectilinear photodiodes whose output signals correspond to the brightness distribution of the light-sensitive face. Such converters are, for instance, side-effect photodiodes or also photodiodes with a neutral wedge filter positioned in front. When a graduated sample passes over one such converter, as shown in FIG. 6, there results an output signal with an alternating current partly substantially shaped as a saw tooth. The alternating current parts are now compared with each other in the evaluation device which can be constructed in a known manner, said comparison being with regard to the change of speed or to the phase position of the signals. The frequency of both saw-tooth signals is the same for both converters. If in the arrangement of the converters ($\beta O = \beta n + 90^\circ$) as shown in FIG. 6, the weft threads are now precisely perpendicular to the advance direction, then the rate of change of both output signals are equal or the phase position of the signals in respect of each other is 0°. As soon as a draft angle $\alpha$ appears, there also results a phase shift of both signals in respect to each other, the same as a difference in the change of speed. The draft angle can now be determined from said differences.

This process of evaluation is also possible in principle with a CCD sensor array.

The above stated features are essential to the invention by themselves and in combination.

What is claimed is:

1. A process for measuring the draft angle $\alpha$ of a weft thread in a travelling textile sheet which comprises:

(a) intercepting light transmitted or reflected from a long narrow field of the travelling textile sheet by a linear array of light sensors, said long narrow field having a predetermined angle in relation to the movement of the textile sheet;

(b) determining the amount of light intercepted by each sensor and classifying the amount of light intercepted by each sensor into only two classes, bright or dark, in relation to a threshold amount of light; and (c) determining the draft angle by continuously monitoring at least the number of sensors, in the linear array, in the same class, the rate at which the sensor in the same array change class or a total length of all sensors in an array with the same class.

2. The process of claim 1 wherein a sign of the draft angle is determined by the direction in which the sensors in an array change class.

3. The process of claim 1 wherein light is intercepted from two long narrow fields that form with each other a defined angle.

4. The process of claim 1 wherein the class of each sensor is an average of a plurality of separate determinations of the class of each sensor.

5. The process of claim 1 wherein the light is in the form of flashes.

6. The process of claim 1 wherein the amount of light intercepted by the sensors is determined in short, chronologically equidistant periods, said periods being sufficiently short and chronologically spaced to provide at least two determinations for each fiber by an individual sensor.

7. In an apparatus for measuring the draft angle of a weft thread in a continuously travelling textile sheet which comprises: at least one source of illumination for lighting a field of the textile sheet; at least one photodetector for absorbing light transmitted through or reflected from the field of the textile sheet and emitting an electric output signal; an evaluation means for evaluating the output signal of the at least one photodetector and emitting a signal substantially proportional to the draft angle wherein said at least one photodetector is formed as a rectilinear arrangement of a plurality of photosensor elements that can be individually scanned, said evaluation means comprising a threshold circuit means for comparing output signals of individual said photosensor elements to a threshold value, for classifying the output signals of the photosensor elements into only two classes, bright or dark, and for determining the number of the photosensor elements in the same class or the rate at which output values of the same class move over the rectilinear arrangement and determines the draft angle from the number or the rate.

8. The apparatus of claim 7 wherein the at least one photodetector comprises a linear array of said photosensor elements and the evaluation means comprises means for determining the thread count or the travelling speed of the textile sheet.

9. The apparatus of claim 7 wherein the at least one photodetector comprises at least two linear arrays of said photosensor elements arranged to form a defined angle with the direction of travel of the textile sheet.

10. The apparatus of claim 9 wherein the at least two linear arrays are of equal length.

11. The apparatus of claim 7 wherein the source of illumination is a flash means.

12. The apparatus of claim 7 wherein the light which reaches the at least one photodetector passes through an optical system having at least one lens.

13. An apparatus for measuring the draft angle of a weft thread in a continuously travelling textile sheet which comprises: at least one photodetector for absorbing light transmitted through or reflected from a field of a textile sheet and emitting an electric output signal; an evaluation means for evaluating the output signal of the at least one photodetector and emitting a signal substantially proportional to the draft angle wherein the at least one photodetector comprises at least two rectilinear arrays of photosensor elements which output signals are respectively proportional to the distribution of brightness on the at least one photodetector or to the positions of bright and dark classes, the longitudinal axis of the at least one photodetector forming defined angles with the travelling direction and wherein, the evaluation means comprises means comparing the change in speed or phase positions of the output signals to each other for determining the draft angle.

* * * * *